United States Patent [19]

O'Sullivan et al.

[11] 3,938,475

[45] Feb. 17, 1976

[54] FIRED HEATER WITH DOUBLE CASING

[75] Inventors: Thomas F. O'Sullivan, Montclair, N.J.; Henricus J. Knol, Voorburg, Netherlands

[73] Assignee: The Lummus Company, Bloomfield, N.J.

[22] Filed: Mar. 12, 1975

[21] Appl. No.: 557,753

Related U.S. Application Data

[63] Continuation-in-part of Ser. No. 470,937, May 17, 1974, abandoned.

[52] U.S. Cl. ..... 122/333; 122/356

[51] Int. Cl.[2] ..... F22B 21/00; F22B 21/30

[58] Field of Search ..... 122/DIG. 1, 333, 356

[56] References Cited

UNITED STATES PATENTS

| | | | |
|---|---|---|---|
| 2,723,651 | 11/1955 | Bliss | 122/333 |
| 3,135,247 | 6/1964 | Griffin | 122/356 |
| 3,352,289 | 11/1967 | Cunningham, Jr. et al. | 122/356 |
| 3,512,506 | 5/1970 | Von Wiesenthal | 122/356 |

*Primary Examiner*—Kenneth W. Sprague

*Attorney, Agent, or Firm*—Richard J. Holton; Michael Klotz; Alice L. Chen

[57] ABSTRACT

This disclosure teaches a direct fired heater with a double casing. The double casing includes a somewhat conventional inner casing having a burner penetrating therethrough and an outer casing spaced from the inner casing to form a passage in flow communication between the atmosphere and the burner. The outer casing surrounds the burner and is provided with an acoustic inner surface to minimize escape of noise. Design of refractory linings with respect to thickness and density allows for maintenance of skin temperature of the inner casing above the condensation ranges of $SO_2$ and $SO_3$.

7 Claims, 6 Drawing Figures

FIRED HEATER WITH DOUBLE CASING

CROSS REFERENCE

This is a continuation-in-part application with respect to our copending U.S. Pat. application No. 470,937 which was filed on May 17, 1974, now abandoned.

BACKGROUND OF INVENTION

Conventional natural draft burners for direct fired heaters have air registers through which combustion air is admitted to a combustion chamber of the heater. Noise generated in the combustion chamber escapes via the air registers to environs of the heater and additional noise is generated by passage of the combustion air through the air registers. This additional noise also escapes to the environs of the heater. Further in conventional natural draft burners, fuel release devices are unshielded and they radiate additional noise which escapes to the environs of the heater.

Current environmental requirements make it necessary to add noise attenuating devices to natural draft burners, so as to limit escape of noise to the environs of the heater. Conventional noise attenuating devices limit escape of noise effectively, but they serve no other useful purpose and, therefore, they add to the cost of the furnace without benefiting thermal efficiency.

Fuels used in refineries and petrochemical plants frequently contain sufficient sulfur to present corrosion problems. One effective way to avoid sulfur corrosion in a heater is to operate the heater with its skin temperature above the $H_2SO_3/H_2SO_4$ condensation range. However, such operation results in high heat losses from the heater to its environs and such operation cannot be maintained under all ambient conditions.

STATEMENT OF INVENTION

Problems of the prior art with respect to noise escape and sulfur corrosion are solved by this invention in a particularly novel, useful, unobvious and facile way. A direct fired heater is provided with an inner casing having at least one natural draft burner penetrating therethrough and an outer casing spaced from the inner casing to form a passage which communicates ambient air to the burner. The passage preferably should have an acoustic inner surface to dampen noise. Accordingly one object of this invention is to limit escape of noise from the combustion chamber and the burner, particularly low frequency noises generated in the combustion chamber.

Another object of this invention is to accommodate increase of the skin temperature of the inner casing by controlling thickness and density of its inner insulation lining. With the double casing arrangement of this invention, several ambient variables affecting skin temperature of the inner casing are eliminated so that it is feasible in practical terms to assure a skin temperature of the inner casing above the sulfur condensing range for all but lowest ambient temperatures. The higher skin temperature generally is provided by using a higher density refractory which coincidentally also has higher spall resistance, greater strength and lower porosity. The higher density refractory is less permeable to gas and will not permit corrosive gas to pass to the skin and will not accumulate as much gas nor condense acid which would attack the skin during a shutdown of the heater. Because effective thermal insulation of the skin of the inner casing is not necessary according to the present invention, low density refractory or two material refractory construction is not required and cost thereby is reduced. Generally speaking this expedient reduces refractory requirements.

Still another object of this invention is to provide the passage between the inner and outer casings with an acoustic surface. The interior of the outer casing can be lined with a thermally insulative and acoustic material, thereby to furnish (inter alia) an extremely effective heat and sound enclosure, optionally divided into chambers to create absorptive splitter attenuation. Because the outer casing generally is arranged about the inner casing, noise emitted from the combustion chamber through the skin of the inner casing is absorbed in the lining of the outer casing. Further, heat losses through the skin of the inner casing are recovered in preheating the combustion air which is drawn through the passage between the inner and the outer casings.

Still another object of this invention is to shield the skin of the inner casing from all ambient conditions, except air temperature (i.e. wind velocity, precipitation, etc.), thus permitting more effective control of the skin temperature of the inner casing.

Still another object of this invention is to obviate need for noise attenuating devices on burners.

Still another object of this invention is to preheat combustion air, thereby reducing fuel requirements.

Still another object of this invention is to improve thermal efficiency of the heater.

Still another object of this invention is to fabricate a heater of the type here contemplated employing inexpensive materials.

Still another object of this invention is to fabricate a heater of the type here contemplated which is simple to design, build and maintain.

Still another object of this invention is to fabricate a heater of the type here contemplated which is suited well otherwise to its intended functions.

DESCRIPTION OF DRAWINGS

The foregoing and other objects, features and advantages will be seen more fully from a detailed description of a preferred embodiment which follows and from claims which also follow, all viewed in conjunction with accompanying drawings wherein:

DESCRIPTION OF PREFERRED EMBODIMENTS

Figure 1:
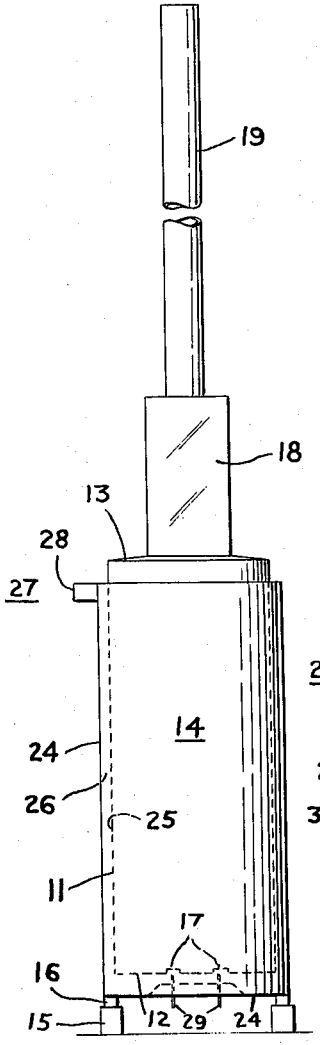
FIG. 1 is an elevational view of a vertical cylindrical heater according to the present invention.
Figure 2:
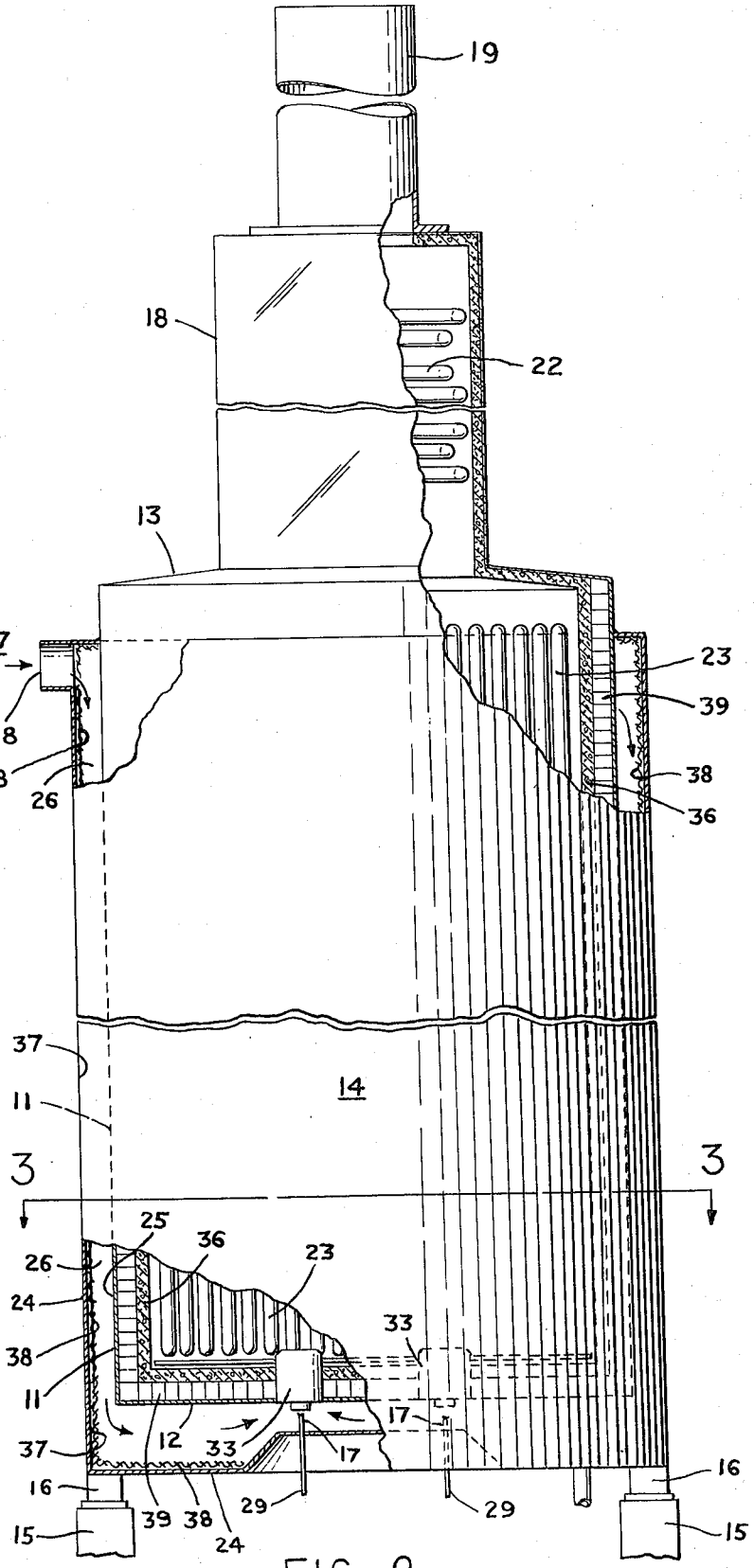
FIG. 2 is an elevational view broken and partly sectioned to an enlarged scale of the heater of FIG. 1.
Figure 3:
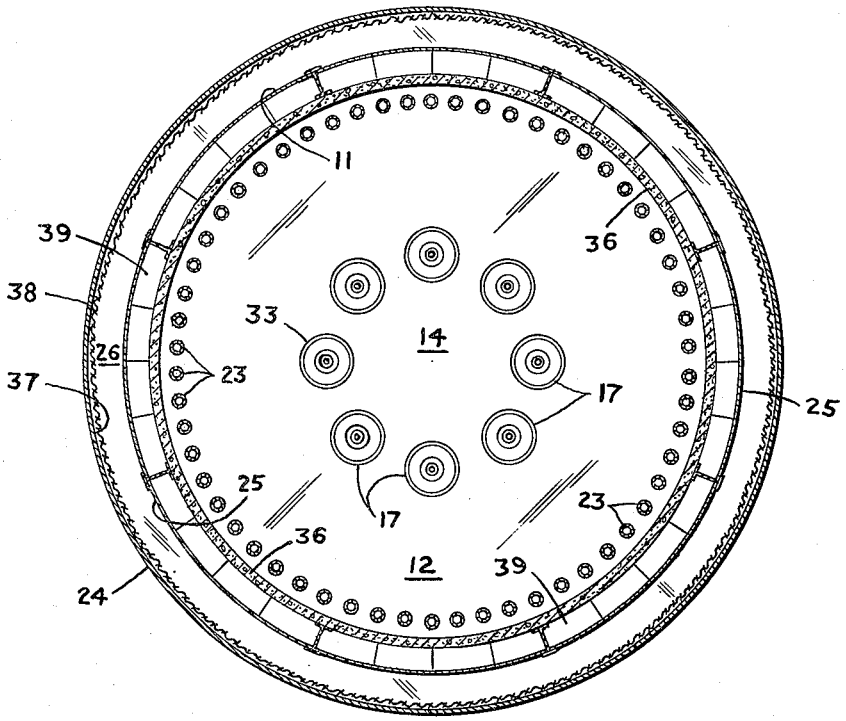
FIG. 3 is a sectional view taken along line 3—3 of FIG. 2.
Figure 6:
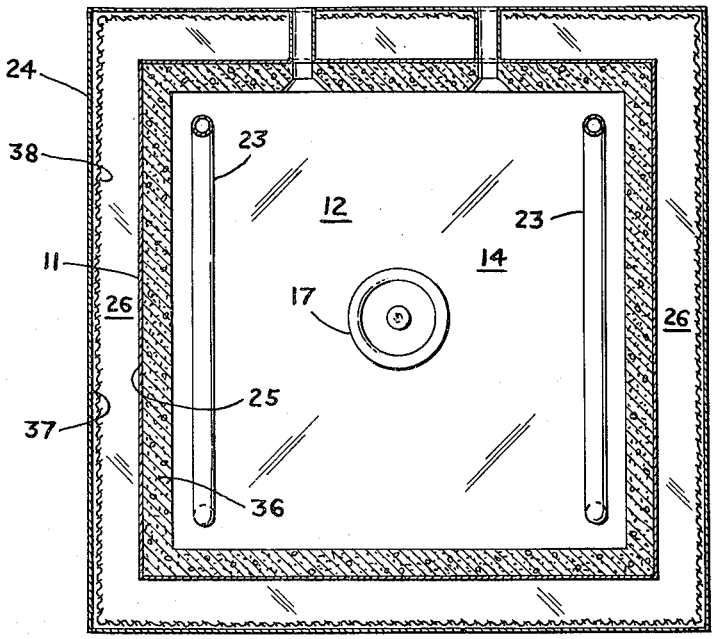
FIG. 6 is a sectional view taken along line 6—6 of FIG. 5.
Figure 4:
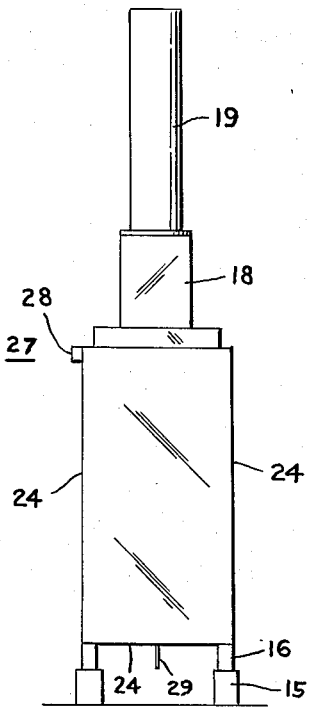
FIG. 4 is an elevational view of a box type heater according to the present invention.
Figure 5:
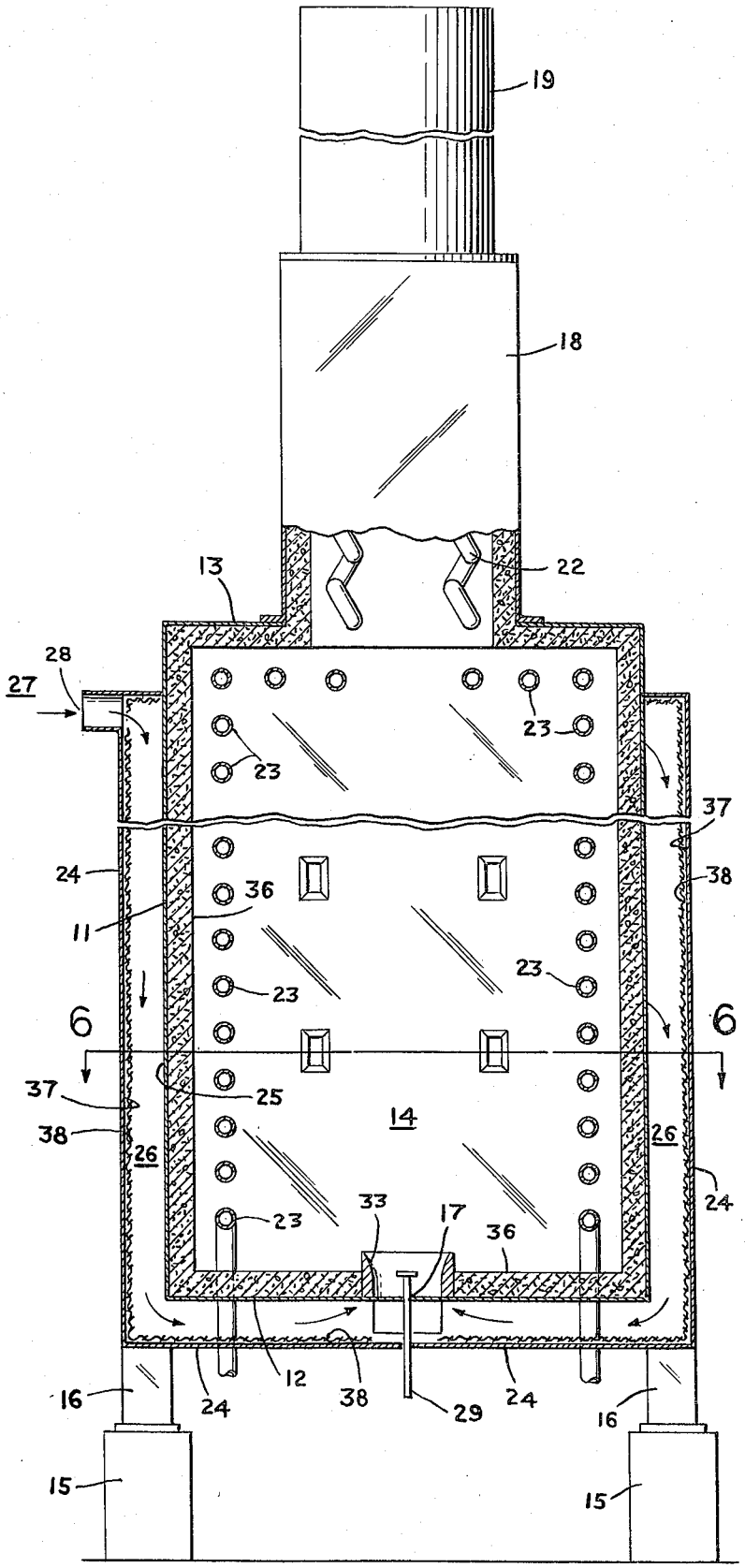
FIG. 5 is an elevational view broken and partly sectioned to an enlarged scale of the heater of FIG. 4.

As seen best in FIGS. 2 and 5, a heater includes a vertical inner casing 11 (cylindrical in FIG. 2 and box-like in FIG. 5) with a bottom 12 and a top 13 all of which enclose a combustion chamber 14. The heaters are supported on piers 15 by means of structural members 16 and they are provided with suitable platforming and associated ladders and stairs (not shown). Burners 17 penetrate via the bottom 12 into the combustion chamber 14. A convection box 18 is provided above the top 13 and a stack 19 is formed thereabove so that hot combustion gases pass from the combustion chamber 14 through the convection box 18 and then up the stack 19. One or more process fluids pass through the heater generally in countercurrent noncontact heat exchange relationship with the hot combustion gases. A process fluid typically courses through a convection tube bundle 22 and then through radiant tubes 23 in the combustion chamber 14.

The crux of the present invention is to provide an outer casing 24 spaced from the bottom 12 and the inner casing 11 so as to form a passage 26 in flow communication between the atmosphere 27 and the burners 17. Preferably the outer casing 24 extends to the vicinity of the top 13 of the combustion chamber 14 and has an opening 28 through which ambient air is drawn. As best seen in FIGS. 2 and 5, the burners 17 are connected to a suitable fuel line 29 and have guns which discharge through ceramic blocks 33. Combustion air registers control delivery of combustion air to the burners 17 in a manner well known in the art.

The inner casing 11 with an outer face 25 is lined internally with a refractory castable insulation 36. To protect the casing 11 from sulfur corrosion, it is desirable to keep the temperature of the casing 11 above the condensation range of sulfur oxides. Toward this objective, the density and thickness of the refractory castable insulation 36 and/or refractory brick 39 are designed accordingly. Design for such refractory insulations are well known in the art.

Escape of noise from the combustion chamber 14 and the burners 17 is controlled by enclosing access of air to the burners 17 via the passage 26 and the opening 28. By this expedient, need for sound attenuating devices generally is obviated. Inner face 37 of the outer casing 24 preferably is provided with an acoustic and/or thermally insulative lining 38. Fiberglass at a density of about 3 pounds per cubic foot or mineral wool at a density of about 6 pounds per cubic foot are useful for lining 38 in that they are low density long fibered materials which have insulative properties and are capable of resisting high air velocities to which they are subjected in passage 26.

It will be understood by those familiar with heater design that wide deviations may be made from the preferred embodiment herein described, without departing from a main theme of invention set forth in the claims which follow.

We claim:

1. A direct fired heater comprising in combination: an inner casing enclosing a combustion chamber and having a first end, at least one burner communicating with the combustion chamber and penetrating the casing via the first end, and an outer casing spaced from the first end to form a passage in flow communication between atmosphere and the burner, said passage being provided with an acoustic and insulative surface.

2. The heater of claim 1 with the inner casing being made of metal lined internally with refractory insulation.

3. The heater of claim 2 with
the inner casing arranged vertically and
having at least one side,
the first end being the bottom of the casing,
the outer casing surrounding the bottom of
the inner casing and extending up the side.

4. The heater of claim 3 with
the inner casing having a top,
the outer casing extending to the vicinity of the top.

5. The heater of claim 4 with the burner having a register in flow communication between the passage and the combustion chamber.

6. The heater of claim 5 with the inner casing a cylinder.

7. The heater of claim 5 with the inner casing a square.

* * * * *